United States Patent [19]

Schmidt et al.

[11] 4,055,014

[45] Oct. 25, 1977

[54] LIGHTED GREETING CARDS

[75] Inventors: Terrance L. Schmidt; Marion E. Thompson, both of Colorado Springs, Colo.

[73] Assignee: The Maytronics Group, Inc., Colorado Springs, Colo.

[21] Appl. No.: 670,109

[22] Filed: Mar. 25, 1976

[51] Int. Cl.[2] ..... G09F 13/00

[52] U.S. Cl. ..... 40/152.2; 40/106.52; 40/28.3

[58] Field of Search ..... 40/152.2, 103 K, 152.1, 40/154, 283, 106.52

[56] References Cited

U.S. PATENT DOCUMENTS

| | | | |
|---|---|---|---|
| 1,843,980 | 2/1932 | Hotchner | 40/130 K |
| 2,118,900 | 5/1938 | Schade | 40/152.2 |
| 2,647,222 | 7/1953 | Nieset | 46/170 X |
| 2,826,844 | 3/1958 | Leika | 40/152.2 |
| 2,906,048 | 9/1959 | Kraus | 40/152.2 |
| 3,289,342 | 12/1966 | Gibson | 40/152.2 |
| 3,416,765 | 12/1968 | Ebner | 40/152.1 X |
| 3,517,937 | 6/1970 | Glass et al. | 40/152.2 X |
| 3,546,802 | 12/1970 | Preston | 40/152 |
| 3,737,647 | 6/1973 | Gomi | 240/6.4 W |
| 3,927,402 | 12/1975 | Thompson | 340/366 B |

*Primary Examiner*—Louis G. Mancene
*Assistant Examiner*—Wenceslao J. Contreras
*Attorney, Agent, or Firm*—Cushman, Darby & Cushman

[57] ABSTRACT

A lighted greeting card having indicia formed on the front face thereof. A backing of rigid polymeric foam material supports a sheet material card thereon, the sheet material card receiving at least one light emitting diode therein. The rear of the backing has first and second openings formed therein for receipt of a battery in one of two positions depending upon how the greeting card is to be displayed. Circuitry for flashing the diode on and off, either periodically or in repsonse to sound, is mounted in a recess in the front face of the backing, hidden by the sheet material card.

9 Claims, 8 Drawing Figures

Fig. 4A
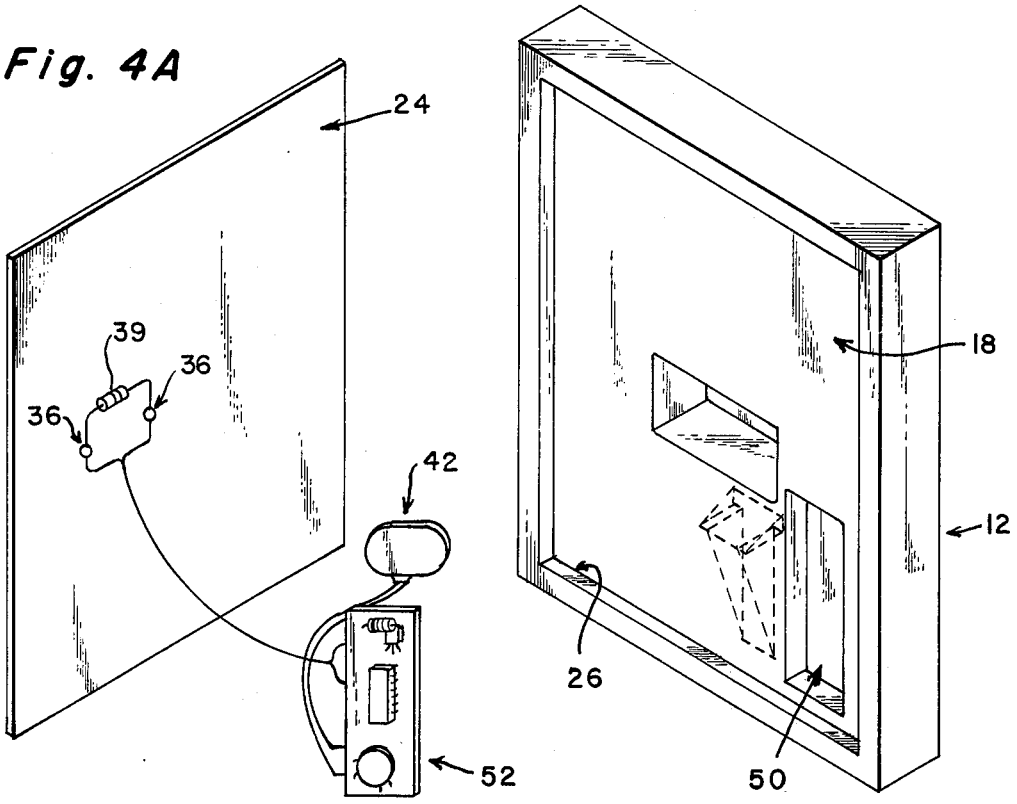
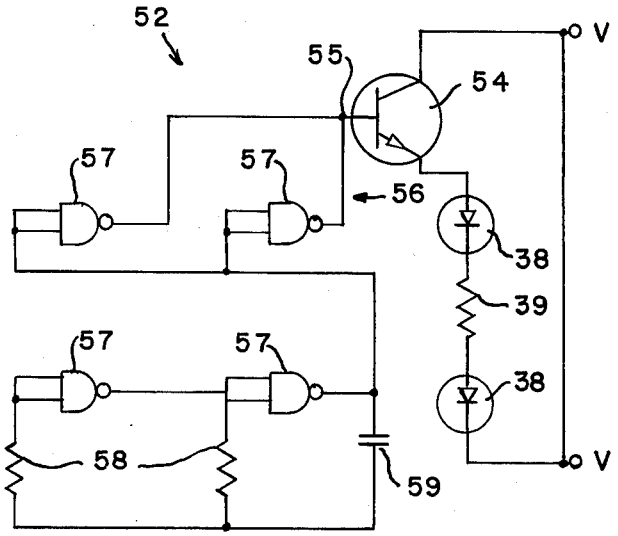
Fig. 4B

LIGHTED GREETING CARDS

BACKGROUND AND SUMMARY OF THE INVENTION

The invention relates to a novel type of greeting card or the like having indicia associated with lights for highlighting certain areas of the front face of the greeting card. For instance, a greeting card may be provided having a face with eyes, or eyes alone, formed thereon with a light source associated with each eye, or a light source associated with other indicia such as car headlights, stars, etc. The light source is adapted to be hooked up to a battery so that it is constantly energized, so that is flashes, or so that it flashes with different frequencies in response to the sound in the area surrounding the greeting card.

In the past, there have been suggestions for the provision of a light source with a greeting card (see for example, U.S. Pat. No. 2,826,844), however, the structure so produced according to such suggestions has been rather bulky and susceptible to damage during shipment with components that are not readily replaceable without a rather major disassembly of the structure. According to the present invention, a greeting card is provided that has specific illumination for parts thereof, with a backing that insures the safety of the electrical components — including relatively fragile circuitry that could not practically be used with the prior art greeting cards. The card may readily be shipped through the mails, and when in use a battery is readily connected up to the illumination source associated with the greeting card, and the card may be held, hung up on the wall, or supported in an upright position on a horizontal surface by the battery.

According to one aspect of the present invention, a greeting card is provided comprising a backing of rigid polymeric foam or the like, a sheet material card received by the backing and having indicia formed on one face thereof, first and second openings formed in the back face of the backing for receipt of a battery, at least one light emitting diode associated with the card, and means for connecting the light emitting diode to a battery disposed in one of the openings therefor in the backing. One of the openings in the backing receives the battery therein in such a manner that it is completely contained within the backing and has no portions thereof extending outwardly from the backing. This is an ideal position for the battery during shipping or wall mounting of the greeting card. The second opening in the backing receives the battery so that it does extend outwardly from the backing, supporting the backing in a generally upright position on a horizontal surface.

circuitry may be provided for the light source for effecting flashing thereof, either in a constant manner, or in a manner dependent upon the sound in the area surrounding the card. An opening is formed in the front face of the backing to receive the circuitry, so that when the card is placed on the front face of the backing, the circuitry is not visible, and the card presents an aesthetically pleasing appearance. None of the electrical components except the light source can be seen when the greeting card is viewed from the front. The rigid polymeric foam backing — preferably styrofoam — positively protects all of the electrical components from damage during shipment or use, and securely receives the components so that they are out of sight, while not adding significant weight or bulk to the greeting card.

It is the primary object of the present invention to provide a lighted greeting card or the like that may readily be shipped without damage thereto (including any electrical circuitry associated therewith) and may be used in a number of different manners. This and other objects of the invention will become clear from an inspection of the detailed description of the invention, and from the appended claims.

BRIEF DESCRIPTION OF THE DRAWINGS

FIG. 4*a* is an exploded view of another exemplary card according to the present invention, having flashing circuitry associated therewith, and FIG. 4*b* is a schematic of the circuitry associated with the card of FIG. 4*a.

DETAILED DESCRIPTION OF THE INVENTION

Figure 1:
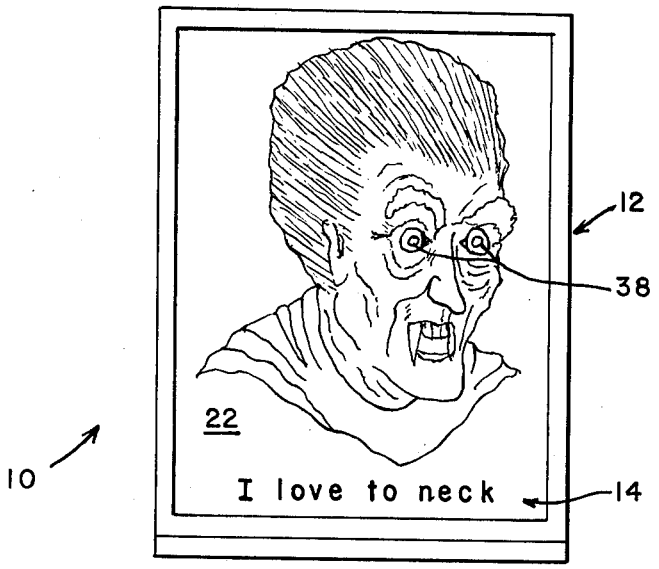
FIG. 1 is a front view of an exemplary greeting card according to the present invention supported in a generally upright position on a horizontal surface.
Figure 2:
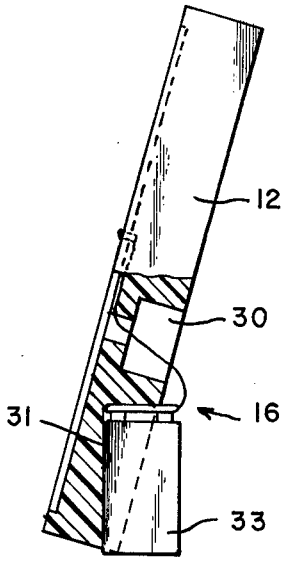
FIG. 2 is a side view, partly in elevation and partly in cross-section of the card of FIG. 1 in its upright position.

A greeting card according to the present invention is shown generally at 10 in FIGS. 1 and 2, supported in a generally upright position on a horizontal surface. The greeting card 10 generally comprises a backing 12 and a sheet material card 14, the card having indicia and a light source associated with the front face thereof. The backing 12 preferably is of rigid polymeric foam, such as thermoplastic and thermosetting synthetic resin foams and rigid natural and synthetic rubber foams. Examples of suitable materials are polystyrene, polyurethane (e.g., three-dimensional polyurethal foam), pheonal formaldehyde and urea formaldehyde foams. The preferred backing material is styrofoam. The card 14 may be made of any sheet material and a plastic overlay or the like can be provided therewith in order to give a three-dimensional effect thereto. Electrical components (including a light source) indicated generally at 16 in FIGS. 1 and 2 are associated with the greeting card 10 for providing lighting of particular portions of the card 14 which can be viewed from the front.

The backing 12 has a front face 18 thereof and a back face 20 thereof. Card 14 also has a front face 22 thereof and a rear face 24 thereof. Means defining a card receiving formation 26 are provided on the front face 18 such as a recessed area as shown in FIG. 4*a.* The rear face 24 of card 14 is placed in engagement with the front face 18 of the backing 12, and it may be affixed thereto by glue or the like if desired. The front face of card 14 has indicia formed thereon, as shown in FIG. 1.

The rear face 20 of the backing 12 has first and second openings 30, 31 formed therein. The first opening 30 is approximately the same size and shape as a battery 33 (i.e. a 9 volt transistor battery) that is to be used to power the light source for the greeting card 10. When a battery 33 is disposed in the opening 30, all portions of it are contained within the backing 12 so that the greeting card 10 may readily be shipped or mounted on a wall (as by a wall hook engaging opening 34 in the rear face 20 of backing 12). When the battery 33 is disposed in the opening 31, a portion of the battery extends outwardly from the backing 12 (see FIG. 2 in particular), and the battery supports the backing 12 in a generally upright position on a horizontal surface. The opening 31 is generally triangular and provides a tight fit for battery 33. In this way, a power source for the greeting card 10 can also serve as a support therefor, while not making the greeting card cumbersome during shipping and while allowing the greeting card 10 to be wall mounted.

Figure 3A:
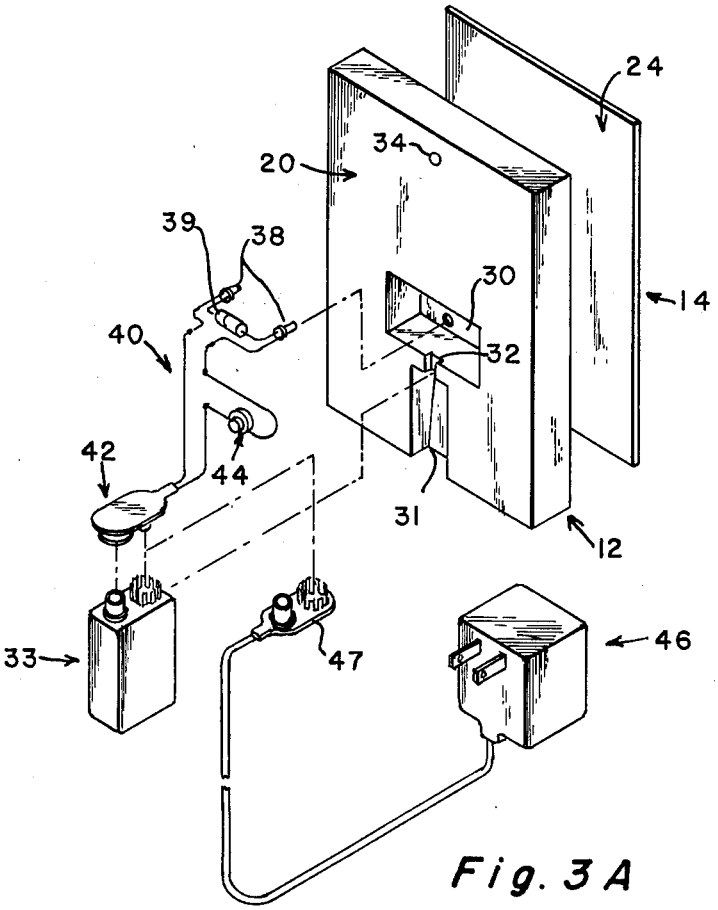
FIG. 3*a* is an exploded view of an exemplary card according to the present invention having an on-off switch associated therewith.
Figure 3B:
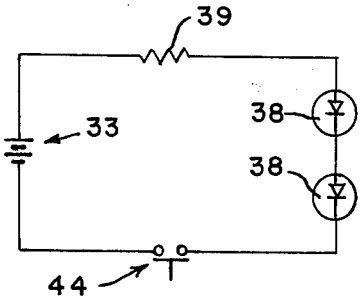
FIG. 3*b* is a schematic circuit diagram for the card of FIG. 3*a;*

At least one opening 36 or the like is formed in the card 14 for receipt of a light emitting diode 38 therein. A light emitting diode is an ideal light source since it is resistant to breakage and provides a true, bright light. Means for releasably connecting the light emitting diode(s) 38 to a battery 33 comprises electrical wires 40 and a releasable connector 42 adapted to be connected to the battery 33. With the light emitting diode(s) 38 disposed in the opening 36 the wires 40 lead through the opening 30 to the battery. The battery 33 may be connected up to the connector 42 whether it is disposed in the opening 30 or the opening 31 and a groove 32 may be provided extending between the openings 30, 31 to allow ready connection of the connector to the battery when the battery is in its position supporting the backing in a generally upright position. While the releasable connector 42 provides for ready connection and disconnection of the power source to the light emitting diode(s) 38, if desired a switch may be disposed in the lines 40 if desired to provide for selective energization of the light emitting diode(s) 38. Such a switch is shown at 44 in FIGS. 3*a* and 3*b* — which is adapted to be disposed in opening 30 or it may be any other type of switch, such as a lever, slide, or mercury switch. Also, if desired, instead of using a battery 33 as the energy source for the light emitting diode(s) 38, an AC adapter 46 may be provided, which adapter 46 has terminals 47 thereof that can be connected to the releasable connection 42 of the wires 40. Preferably, a resistor 39 is also provided in series with the light emitting diode(s) 38, such as a 220 ohm resistor.

If it is desired to make the light emitting diode(s) 38 flash on and off to provide a special visual effect, this may be accomplished according to the present invention by providing circuitry 52 connected to the diode(s) 38. A recess 50 is provided in the front face 18 of the backing 12 for receipt of the circuitry 52 which circuitry preferably is solid state circuitry mounted on a printed circuit board or the like, as shown in FIG. 4*a*. With the circuitry 52 disposed within the backing 12, it is protected from damage, and the provision of the circuitry in the front face 18 of the backing 12 means that the card 14 covers it so that no adverse visual impact is provided by the circuitry 52. The circuitry 52 preferably comprises a transistor 54, such as a 2N3904 transistor, connected in series with the light emitting diode(s) 38 and resistor 39 with the control terminal 55 of the transistor 54 connected to a conventional oscillating circuit 56 shown in FIG. 4*b*. The oscillating circuit 56 shown in FIG. 4*b* comprises a number of NAND gates 57, resistors 58 and a capacitor 59 (such as a 0.1 microfarad capacitor) connected as shown in FIG. 4*b*.

Figure 5A:
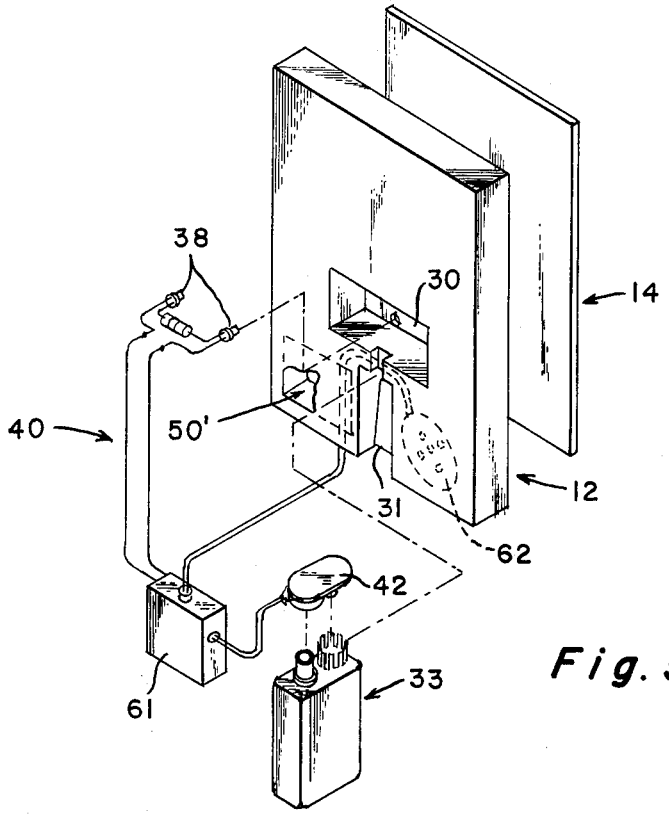
* and FIG. 5*a* is an exploded view of still another exemplary card according to the present invention, having soundresponsive flashing circuitry associated therewith
Figure 5B:
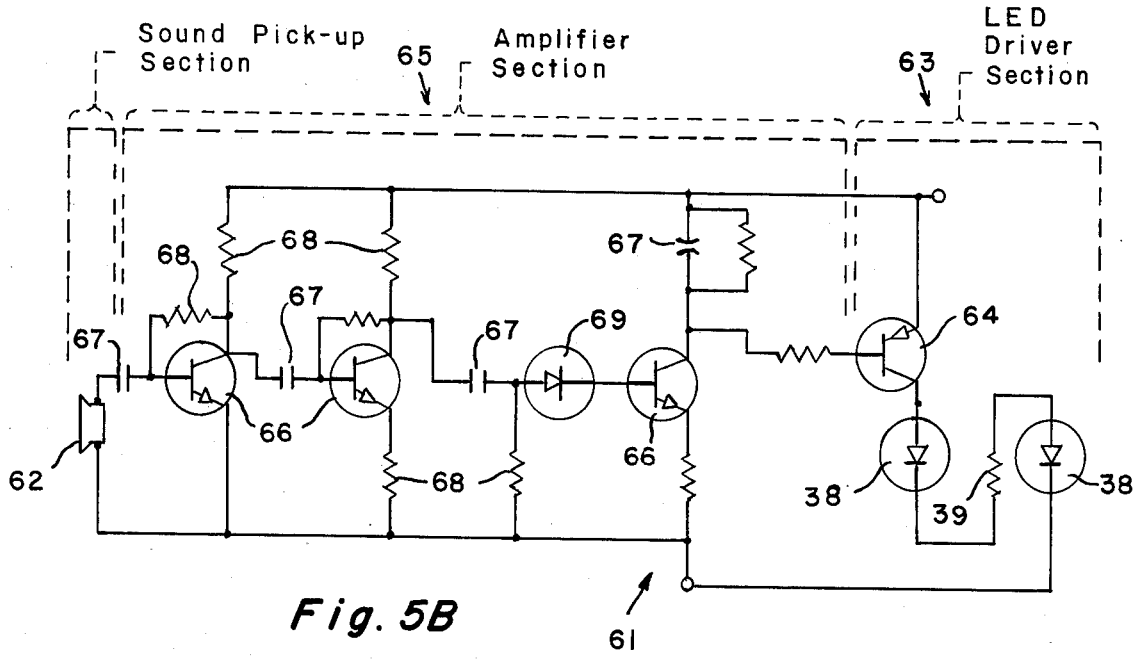
FIG. 5b is a schematic of the circuitry of the card of FIG. 5*a.*

Another embodiment of a greeting card 10 according to the present invention is shown in FIGS. 5*a* and 5*b*, this embodiment having circuitry 61 associated therewith for modulating the frequency of flashing of the light emitting diode(s) 38 in response to sound. The circuitry 61 is also disposed in a recess 50' formed in the front face 18 of the backing 12 and a sound pickup 62 is provided on the front face 18 of the rigid polymeric foam backing 12 as shown in FIG. 5*a*. The sound pickup 62 and the circuitry 61 are both hidden by the card 14. The circuitry 61 includes a light emitting diode driver section 63 including a transistor 64 (such as a 2N3906) an amplifier section 65, including a series of transistors 66 (such as 2N3904 transistors), capacitors 67, resistors 68, and a diode 69, and the sound pickup 62.

It will thus be seen that according to the present invention, a greeting card has been provided that provides a lighted message, can be shipped through mails, hung on a wall, or stood up upon a horizontal surface, without any fear of damage to the component parts thereof, and circuitry can be provided therewith for flashing the light source on and off.

While the invention has been herein shown and described in what is presently conceived to be the most practical and preferred embodiment thereof, it will be apparent to those of ordinary skill in the art that many modifications may be made thereof within the scope of the invention which scope is to be accorded the broadest interpretation of the appended claims so as to encompass all equivalent structures and devices.

What is claimed is:

1. A greeting card comprising a. a backing of rigid polymeric foam or the like having front and rear spaced, substantially parallel faces, b. a sheet material card having front and rear faces, said front face having indicia formed thereon and said rear face being adapted to be received by said backing front face, c. means defining a card receiving formation on said front face of said backing, d. a battery, e. means defining a first opening in said backing rear face, said first opening for receiving said battery, and said first opening dimensioned so that when said battery is received thereby no portion of the battery protrudes exteriorly of said backing, but rather said battery is generally completely contained within said first opening, f. means defining a second opening in said backing rear face, said second opening for receipt of said battery, and said second opening dimensioned so that when said battery is received thereby said battery extends outwardly from said backing rear face and supports said backing on a horizontal surface in a generally upright position.

g. means defining at least one opening in said sheet material card for receipt of a light emitting diode therein, h. at least one light-emitting diode disposed in said card opening for receipt thereof, said diode being visible when viewing said card front face, and i. circuitry means for releasably connecting said light emitting diode to said battery, said circuitry means not being visible when viewing said card front face.

2. a greeting card as recited in claim 1 wherein said circuitry means comprises a on-off switch operatively connected to said means for releasably connecting said light emitting diode to said battery so that current may selectively be allowed to flow or be prevented from flowing from said battery to said light emitting diode.

3. A greeting card as recited in claim 1 wherein said circuitry means comprises means for releasably connecting said light emitting diode to said battery, to effect flashing operation of said light emitting diode.

4. A greeting card as recited in claim 3 wherein said backing has means defining an opening in the rear face thereof for receipt of said circuitry means,

5. A greeting card as recited in claim 4 wherein said circuitry means comprises a transistor connected in series with said light emitting diode and said battery, and an oscillating circuit connected to the control terminal of said transistor.

6. A greeting card as recited in claim 4 wherein said circuitry means modulates the frequency of flashing of said light emitting diode in response to sound.

7. A greeting card as recited in claim 6 wherein said circuitry means includes an amplifier section and a LED driver section and wherein a sound pickup for said circuitry means is disposed in an opening formed in said front face of said backing.

8. A greeting card as recited in claim 1 wherein said backing is styrofoam.

9. A greeting card as recited in claim 1 wherein the peripheral portions of said backing comprise the peripheral portions of said greeting card.

* * * * *